US010339763B1

(12) United States Patent
Fiorini

(10) Patent No.: US 10,339,763 B1
(45) Date of Patent: Jul. 2, 2019

(54) COMPUTER GAME OF CHANCE

(71) Applicant: Jude Fiorini, Middletown, MD (US)

(72) Inventor: Jude Fiorini, Middletown, MD (US)

( * ) Notice: Subject to any disclaimer, the term of this patent is extended or adjusted under 35 U.S.C. 154(b) by 0 days.

(21) Appl. No.: 15/663,536

(22) Filed: Jul. 28, 2017

Related U.S. Application Data

(60) Provisional application No. 62/369,259, filed on Aug. 1, 2016.

(51) Int. Cl.
*A63F 7/00* (2006.01)
*G07F 17/32* (2006.01)

(52) U.S. Cl.
CPC ..... *G07F 17/3288* (2013.01); *G07F 17/3213* (2013.01); *G07F 17/3244* (2013.01); *G07F 17/3262* (2013.01)

(58) Field of Classification Search
CPC ..... G07F 17/3212; G07F 17/3244; G07F 17/3262
See application file for complete search history.

(56) References Cited

U.S. PATENT DOCUMENTS 6,047,963 A * 4/2000 Pierce ..... A63F 7/022 273/121 B
6,139,013 A * 10/2000 Pierce ..... A63F 7/022 273/121 B
2001/0011797 A1* 8/2001 Pierce ..... A63F 7/022 273/138.1
2003/0176212 A1* 9/2003 Schlottmann ..... A63F 13/005 463/20
2004/0002380 A1* 1/2004 Brosnan ..... A63F 13/10 463/32
2013/0053123 A1* 2/2013 Nicely ..... G07F 17/326 463/20

* cited by examiner

*Primary Examiner* — James S. McClellan
*Assistant Examiner* — Kevin M Carter
(74) *Attorney, Agent, or Firm* — Dergosits & Noah LLP; Todd A. Noah

(57) ABSTRACT

A computer game of chance is described. A system displays, via a user interface, at least a part of a field of play associated with a game of chance. The system receives, via the user interface, a user selection of a region within the field of play. The system evaluates a probability that an object will traverse the user-selected region during any of the random movements by the object from a beginning area to an ending area during a round of play. The system displays, via the user interface, the object moving in the field of play during at least some of the random movements. The system credits a success value, based on the probability, to a player of the game of chance if the object traversed the user-selected region during any of the random movements during the round of play.

20 Claims, 12 Drawing Sheets

COMPUTER GAME OF CHANCE

CLAIM OF PRIORITY

This application claims the benefit of U.S. Provisional Patent Application No. 62/369,259, filed Aug. 1, 2016, the entire contents of which are incorporated herein by reference.

BACKGROUND

Games of chance which do not have an element of skill typically include multiple possible game states and a random selection process that defines one of the game states as the winning outcome. For example, the game of craps uses two 6-sided dice that are rolled to yield 36 possible outcomes, American roulette uses a ball that is rolled into a spinning wheel where it comes to rest in one of 38 possible cups, and slot machines use multiple reels that each have numerous possible discrete stops, such as locations on the reel distinguished by symbols, that come to rest to reveal a particular combination (typically in the tens of thousands) of symbols.

The gaming industry is interested in new games, or modifications to existing games, which keep players interested and reduce the possibility that players will cease playing and wagering due to decreasing interest. One way that the excitement of wagering games can be enhanced is by increasing suspense in the outcome, which can be achieved by revealing the outcome over multiple random steps during a timeframe that is long enough for the player to appreciate the fluctuating probability of success as this probability increases and decreases during a round of play. Examples of games that increase suspense in the outcome include sports betting and card games, in which the likelihood of success changes as a round of play progresses. Craps, roulette, and slot machines lack this type of suspense because the outcomes are revealed relatively instantaneously as the dice, ball, and reels come to stop in a fraction of a second.

Games of chance that increase suspense in the outcome include the Galton box (also known as the quincunx or bean machine), which was invented by Sir Francis Galton in the $19^{th}$ century to demonstrate the central limit theory. The Galton box consists of a vertical board with multiple interleaved rows of pegs, with a single row of bins across the bottom of the board. Balls are released from the top center of the board, and as a ball drops, the ball encounters a peg that causes the ball to bounce to the left and right with roughly equal probability, and proceeds to the next row of pegs, where the process repeats until the ball passes through the last rows of pegs to be collected into one-ball-wide bins at the bottom of the board. The height of the balls in the bins approximates a bell-shaped curve (such as the Normal probability distribution), thereby demonstrating the central limit theorem.

Modeled after the Galton box, Plinko is a game of chance that debuted on the television program "The Price is Right" on Jan. 3, 1983. A player drops a disc from the top of a vertical board with interleaved rows of pegs, and the disc eventually comes to a rest in one of the bins at the bottom of the board, to which various payout values have been assigned. The Plinko disc rattles side to side as it traverses the board, producing visual excitement and generating suspense in the outcome for each round of play. As the disc moves towards the bins with the higher payouts, the player becomes more excited as the probability of success increases, and as the disc moves away towards the bins with the lower payouts, the player becomes less excited as the probability of success decreases.

DETAILED DESCRIPTION

Figure 1:
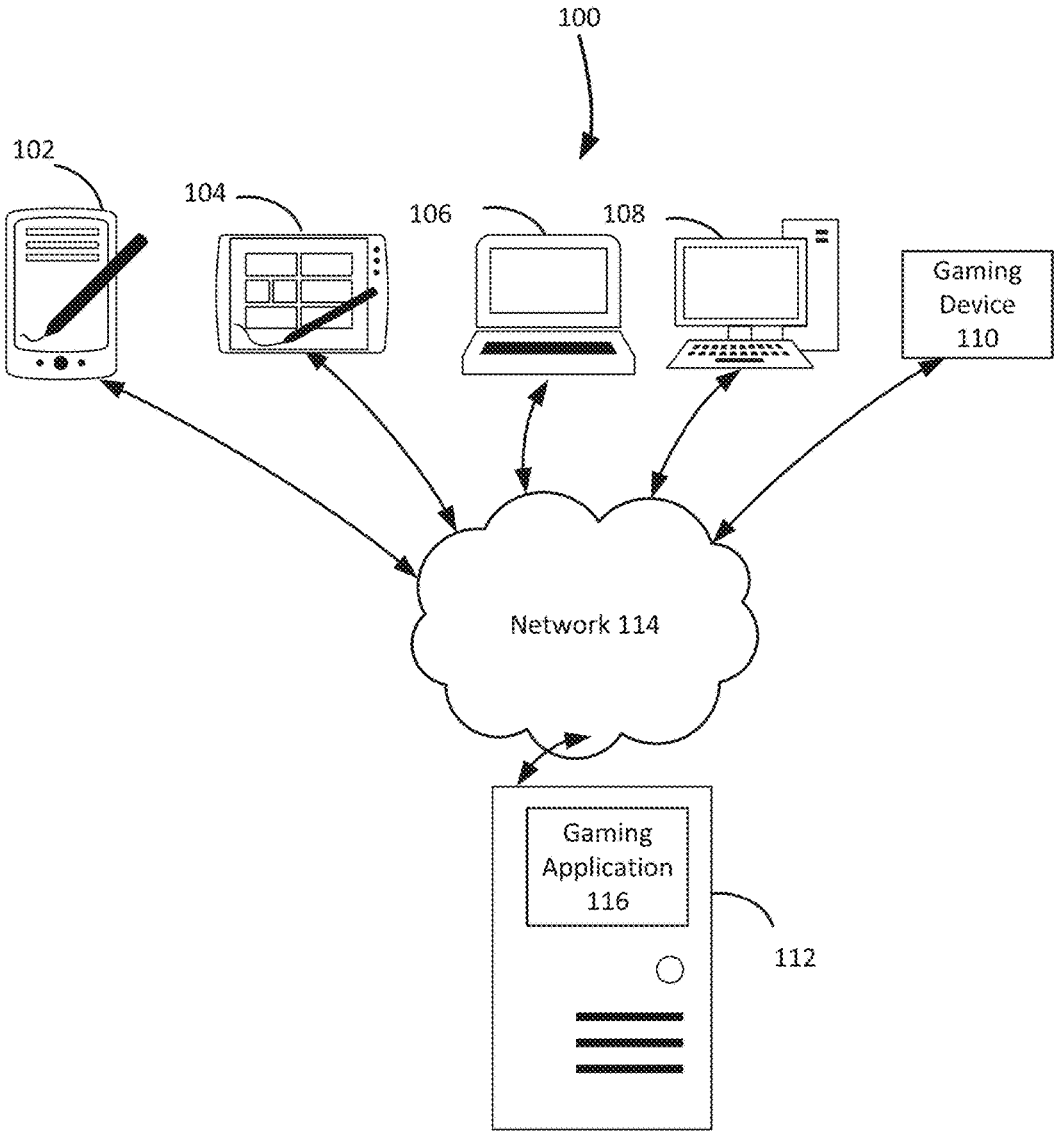
FIG. 1 illustrates a block diagram of an example system for a computer game of chance, under an embodiment.

Plinko or a Galton box can be implemented as a wagering game by a dedicated gaming device used by a player or a computer network that convert's a player's computer (such as a mobile phone or a laptop computer) into an online gaming device. A player can select an amount to wager, and each of the bins may be associated with a particular value multiplier, such as applying a value multiplier of 15.0 to the player's wager of $2 when the ball lands in a bin that has a success probability of 0.0666 (1 divided by 0.0666 equals 15.0), thereby resulting in a payout of $30 (the value multiplier of 15.0 multiplied by the player's wager value of $2). However, since the range of value multipliers is limited by the probabilities of the bins, the player may not be able to wager with value multipliers that suit their individual preferences. Since the lower value multipliers occur at bins that are in the middle of the field of play and the higher value multipliers occur at bins that are at the periphery of the field of play, there is no way for the player to place a wager on a bin in the middle that has a relatively higher value multiplier if the player believes the ball will end up in the middle. Furthermore, a player cannot wager based on value multipliers of 2.0 or 10.0 because these value multipliers would require probabilities of success of 50% and 10%, respectively. It is theoretically possible to allow a player to design a wager with these particular value multipliers if the player could combine an aggregate of bins with the appropriate probability of success and then wager that the ball will fall into one of the aggregated bins. For example, a player could take the time and effort to combine an aggregate of 3 bins with the aggregate probability of 49.3%, which would result in a value multiplier of 2.03 upon success, or combine an aggregate of 9 peripheral bins with the aggregate probability of 9.86%, which would result in a value multiplier of 10.14 upon success. The time and effort required to devise such value multipliers that are only approximations of the player's desired value multipliers makes such a solution quite clumsy and undesirable. In addition, there is no way for the player to move the player's aggregated collection of bins around the field of play to other locations, such that the player would be restricted to settling on the fixed locations of the aggregated bins, which is also very undesirable because players may like to guess where the ball might fall. Lastly, there is no way for the player to wager where the ball will be earlier in the round of play.

Embodiments herein enable a computer game of chance. A system displays, via a user interface, at least a part of a field of play for a game of chance. The system receives, via the user interface, a user selection of a region within the field of play. The system evaluates a probability that an object will traverse the user-selected region during any of the random movements by the object from a beginning area to an ending area during a round of play. The system displays, via the user interface, the object moving in the field of play during at least some of the random movements. The system credits a success value, based on the probability, to a player of the game of chance if the object traversed the user-selected region during any of the random movements.

For example, a smartphone's display screen displays a computer game's field of play. The smartphone's user interface receives the player's selection of a region close to the upper middle of the field of play and a wager of $2.00 that the game disc will traverse the selected region. A gaming application estimates a 20% probability that a game disc will traverse the user's selected upper middle region of the field during any of the disc's random movements from the beginning at the top of the field to the ending at the bottom of the field during a round of play. The smartphone's display screen displays the game disc moving in the field during the game disc's random movements. The gaming application credits $10.00 to the player, based on the 20% probability (or 1 success in 5 chances, which results in a value multiplier of 5) and the player's $2.00 wager because the game disc traversed the user's selected upper middle region during the game disc's random movements during the round of play.

FIG. 1 illustrates a block diagram of an example system 100 for a computer game of chance, under an embodiment. As shown in FIG. 1, the system 100 may illustrate a cloud computing environment in which data, applications, services, and other resources are stored and delivered through shared data-centers and appear as a single point of access for the end users. The system 100 may also represent any other type of distributed computer network environment in which servers control the storage and distribution of resources and services for different client users.

In an embodiment, the system 100 represents a cloud computing system that includes a first gaming device 102, a second gaming device 104, a third gaming device 106, a fourth gaming device 108, a fifth gaming device 110; and a computer 112 that may be provided by a hosting company. The gaming devices 102-110 and the computer 112 may communicate via a network 114. Although FIG. 1 depicts the system 100 with five gaming devices 102-110, one computer 112, and one network 114, the system 100 may include any number of gaming devices 102-110, any number of computers 112, and any number of networks 114. Further, although FIG. 1 depicts the first gaming device 102 as a smartphone 102, the second gaming device 104 as a tablet computer 104, the third gaming device 106 as a laptop computer 106, the fourth gaming device 108 as a personal computer 108, the fifth gaming device 110 as a dedicated gaming device 110, and the computer 112 as a server 112, each of the system components 102-112 may be any type of computer system. For example, any of the mobile gaming devices 102-106 may be a mobile phone, a tablet computer, a laptop computer, a portable computer, a wearable computer, a dual mode handset, a dual subscriber identification module phone, a wireless mobile device, a pager, a personal digital assistant, a digital video player, a digital camera, a digital music player, a digital calculator, and/or an electronic key fob for keyless entry. The system elements 102-112 may each be substantially similar to the hardware device 1200 depicted in FIG. 12 and described below. Although FIG. 1 depicts a gaming application 116 residing on the computer 112, the gaming application 116 may reside fully and/or partially on any or all of the system elements 102-112.

The system 100 provides a computer game of chance that creates suspense by utilizing a graphic game object that traverses a random path to arrive at the winning outcome, which may be for a wager, and provides the players the opportunity to choose the outcome, on which they may wager. During each round of play, a designated graphic game object (such as a game disc) traverses a random path within a field of play. The objective of a round of play is to select a delimited region(s) within the field of play that encompasses the random path traversed by the graphic game object. The word "region" used here and hereafter implies a subset of the game space, both mathematically and graphically.

Figure 2:
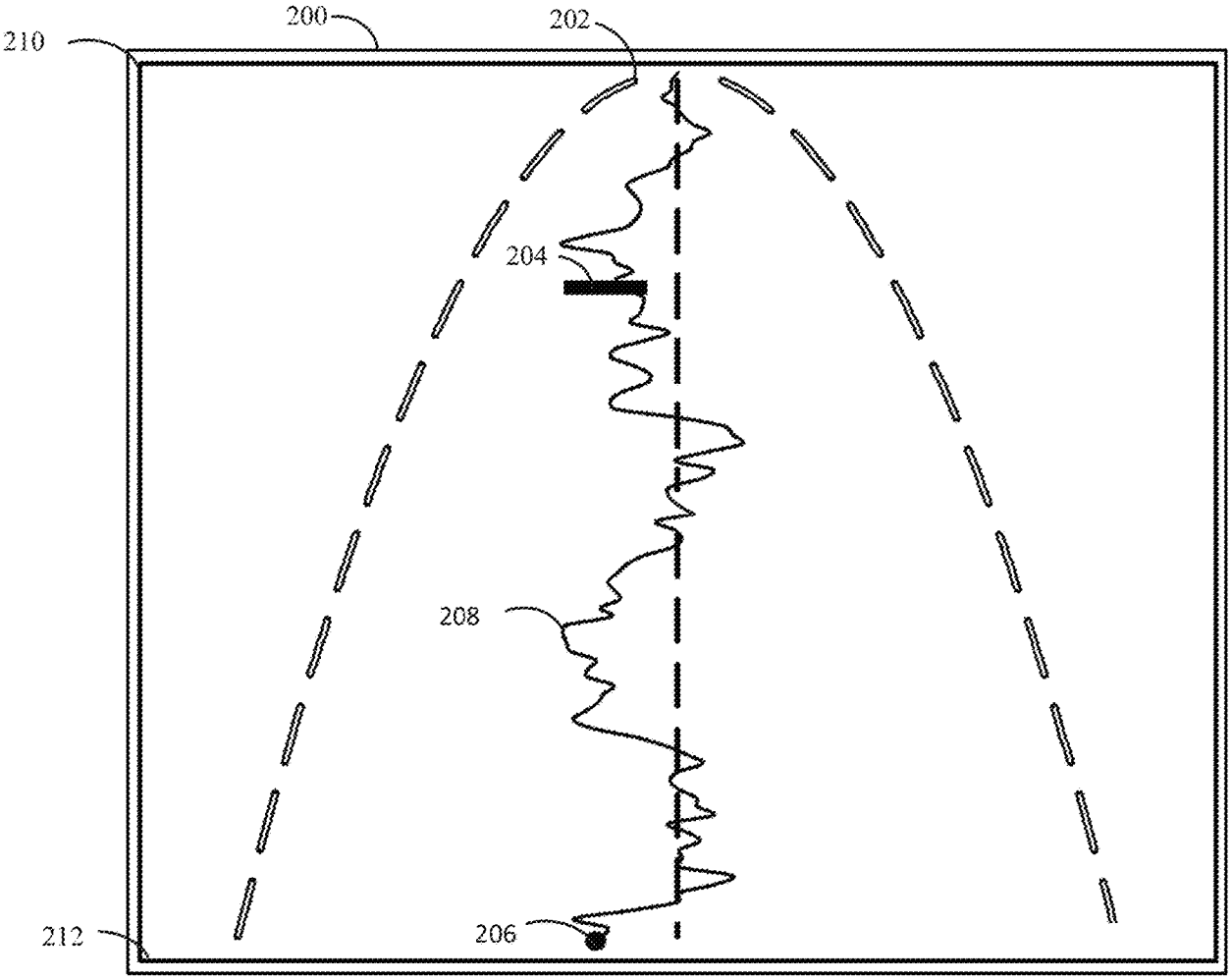
FIGS. 2-10 illustrate frames of example user interface screens of devices supporting methods for a computer game of chance, under an embodiment.

A user interface displays at least a part of a field of play associated with a game of chance. For example and without limitation, this may include the display screen of the smartphone 102 displaying a computer game's playing field. FIG. 2 illustrates a frame 200 that depicts an example playing field, and a confidence interval 202 that is the 95% confidence interval for the horizontal location of the graphic game object at each step during a round of play. A user interface can be the space where interactions between humans and computer occur. A part can be a piece or segment of something such as an object, which combined with other pieces makes up the whole. A field of play can be a geographic location where a a round of play occurs. A game of chance can be a form of play or sport, especially a competitive one played according to rules, and whose outcome is strongly influenced by some randomizing device.

Having displayed the field of play, the user interface receives a user selection of a region within the field of play. By way of example and without limitation, this may include the user interface of the smartphone 102 receiving the player's selection of a small region close to the upper middle of the field of play. FIG. 2 illustrates an example user-selected region 204 in the field of play. The user interface enables a player to select a region where the random movement object will be earlier in the round of play than the final expected locations of the object. A user selection can be the act of a human operating a computer to choose something as being the most suitable. A region can be an area, division, or part of a field of play.

Figure 3:
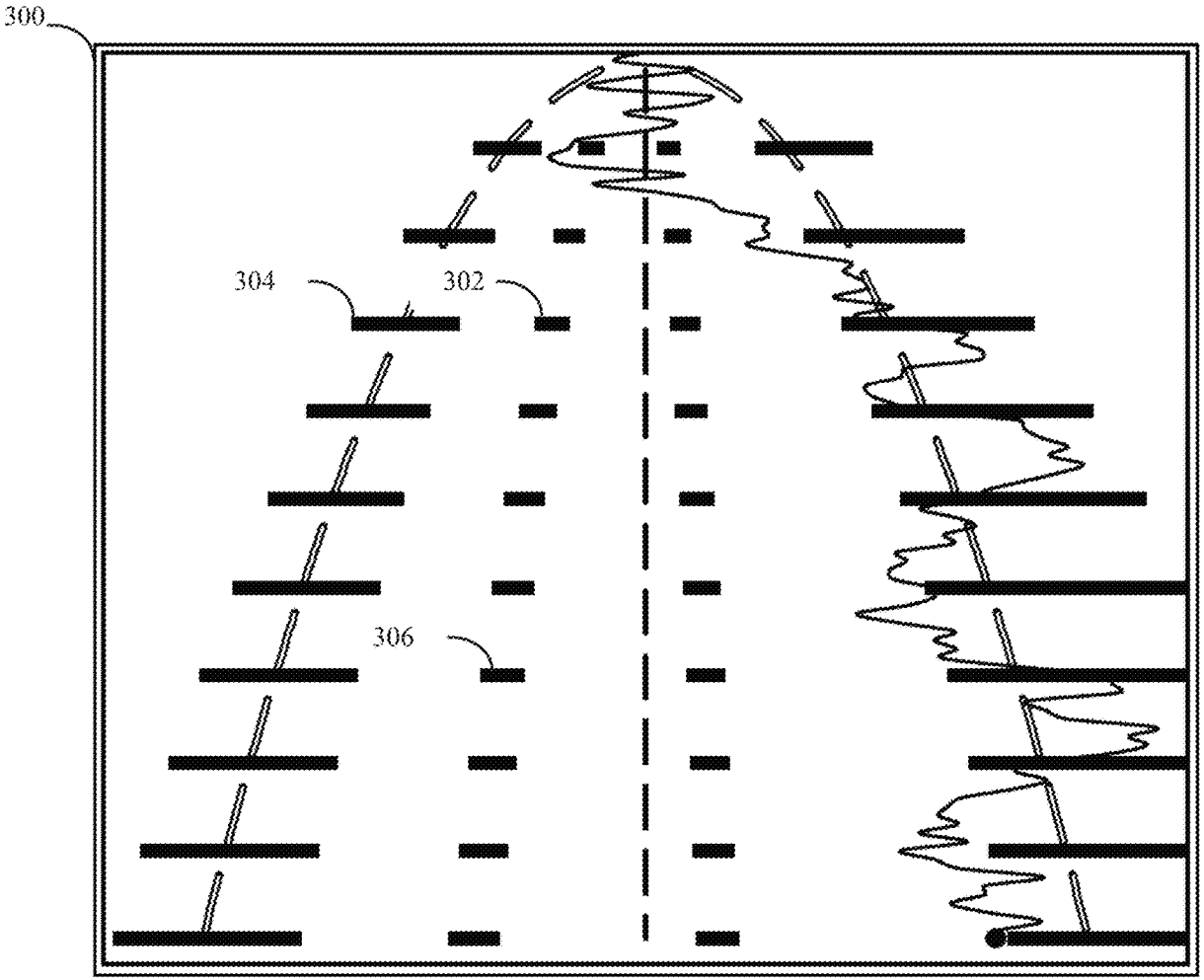

The selection of the region may include the selection of a geographical location of the region, a geographical dimension of the region, and/or the probability of a successful traversal of the region. For example, if a player desires to place a wager with a value multiplier of 10 times the value wagered, the probability that the object will traverse the region corresponding to this wager should equal to 10% (1/10=0.10, assuming a true odds payout, such that the "house edge" is equal to zero and the mean return on a value wagered is 100%). The gaming application 116 can calculate the necessary width for the region used to depict a wager with a 10% chance of success based on the mathematical rules used to generate the random path for the disc. For this particular embodiment, the width of the region is dependent upon the location that the region is placed within the field of play. In another embodiment, the random movements are generated in a way that bounds the field of play within a square, and a given horizontal distance corresponds to the same probability, regardless of its vertical or horizontal location within the field of play. FIG. 3 illustrates a frame 300 that includes a field of play which indicates the relative sizes for regions 302-306 that each have a 10% chance of success, when placed at various locations within the field of play. The relative width of the region 302 increases as the region is moved horizontally from the center of the field of play towards the region 304 located at the periphery of the field of play. Similarly, the width of the region 302 increases as the region is moved down the field of play towards a region 306 located closer to the end of the field of play. A player can easily design a wager with any desired value multiplier, which reflects the player's preferred level of risk, and place the corresponding region anywhere on the field of play, and the gaming application 116 can calculate the appropriate width of the region and change the width of the region as the player moves the region to the desired location. Alternatively, the player can select the location and the width of the region without initially evaluating the probability of the region's traversal and without the initial involvement by the gaming application 116.

Along with the user selection of the region, the user interface can receive a selection of a wager value. In embodiments, this may include the user interface of the smartphone 102 receiving the player's wager of $2.00. Prior to each round of play, a wager (or multiple wagers) may be made by the player selecting an amount to wager that corresponds to the playing field's region that the user selected or will select. A successful wager requires that the graphic game object traverses the user's selected region by either passing through the user's selected region during the round of play or coming to a rest at the user's selected region at the end of the round of play. Although this example describes a player wagering money to play a game of chance, the player may subscribe to a service that provides the game of chance, or the player may play the game of chance free of any charge associated with the gaming application 116.

After receiving the user's selection of the region, the system 100 evaluates a probability that an object will traverse the user-selected region during any of the random movements by the object from a beginning area to an ending area during a round of play. For example and without limitation, this may include the gaming application 116 estimating a 20% probability that the game disc 206 will traverse the user's selected upper middle region 204 during any of the game disc's random movements 208 from the beginning at the top of the field 210 to the ending at the bottom of the field 212 during the round of play. The gaming application 116 can calculate the probability based on the mathematical rule(s) used to generate the random path 208 traversed by the object 206 and the length, area, or volume (for a one-dimensional, two-dimensional, or three-dimensional versions of the game, respectively) of the region 204 that was selected by the player. Having evaluated the probability of a successful traversal, the user interface optionally displays the probability and/or a success value. By way of example and without limitation, this may include the display screen of the smartphone 102 displaying the 20% probability that the game disc 206 will traverse the user's selected upper middle region 204 and the $10.00 that the player will receive if the game disc 206 traverses the user's selected upper middle region 204. A probability can be the extent to which an event is likely to occur, measured by the ratio of the favorable cases to the whole number of cases possible. An object can be a thing that can be seen. A random movement can be a chaotic, haphazard motion. A beginning area can be the point in space at which something starts. An ending area can be the point in time at which something stops. A round of play can be an instance of an activity for enjoyment and recreation.

Following the evaluation of the successful traversal probability, the user interface displays the object moving in the field of play during at least some of the random movements. In embodiments, this may include the display screen of the smartphone 102 displaying the game disc 206 moving in the field during the game disc's random movements 208. FIG. 2 illustrates the game disc 206 traversing the random path 208 over multiple steps from the start area 210 at the top of the field of play to the end area 212 at the bottom of the field of play. During each step, the game disc 206 moves vertically down the screen at a distance, which may be a uniform vertical distance or a random vertical distance, and horizontally either left or right a distance, which may be a random horizontal distance or a uniform horizontal distance. The gaming application 116 can use a continuous probability distribution, such as the uniform probability distribution or the normal probability distribution, to determine each random movement of the object. The gaming application 116 can also use a discrete probability distribution, if the ranges are small enough and rounding errors are adjusted, to determine each random movement of the object.

After displaying random movements by the object, a determination is made whether the object traversed the user-selected region during any of the random movements. By way of example and without limitation, this may include the gaming application 116 determining whether the game disc 206 traversed the user's selected upper middle region 204 during any of the game disc's random movements 208. If the object traversed the user-selected region during any of the random movements, a success value is credited, based on the successful traversal probability, to a player of the game of chance. In embodiments, this may include the gaming application 116 crediting $10.00 to the player, based on the 20% probability (or 1 success in 5 chances, which results in a value multiplier of 5) and the player's $2.00 wager, because the game disc 206 traversed the user's selected upper middle region 204 at the traversal point 214 during some of the game disc's random movements 208 during the round of play. The value to be credited for a successful traversal is a function of the probability that the requisite event(s) takes place. If the object did not traverse the user-selected region during any of the random movements, the player of the game of chance can be debited the wager value. For example and without limitation, this may include the gaming application 116 taking the $2.00 wager from the player because the game disc 206 did not traverse the user's selected upper middle region 204 during any of the game disc's random movements 208 during the round of play. A success value can be the numerical amount denoted by an algebraic term; a magnitude, quantity, or number that is based on the accomplishment of an aim or purpose. A wager value can be the numerical amount denoted by an algebraic term; a magnitude, quantity, or number that is risked on the occurrence of a future event. Although examples herein describe wager values based on money, a wager value may be based on credits, points, or any form of virtual currency.

The gaming application 116 can also provide the opportunity for the player to cash in their wager by accepting a real-time payout offer during the round of play, prior to the final outcome of the wager being determined at the expected end of the round of play. The gaming application 116 can determine the value of the real-time payout offer as the true-odds expected value of the wager, based on the current game state at the time of the offer. Although this example describes the true-odds expected value of wager to make the math more easily understood, by ignoring the house edge, gaming application 116 may offer a percentage of the true-odds expected value, and retain the remainder of the true-odss expected value as the house edge, or profit. The gaming application 116 can determine the expected value of the wager by calculating the probability that the wager will be a success, based on the current (real-time) location of the object (relative to the user-selected region) and the mathematical rules used to generate the random path. The expected value can be the product of this probability and the payout value for a successful wager.

Figure 4:
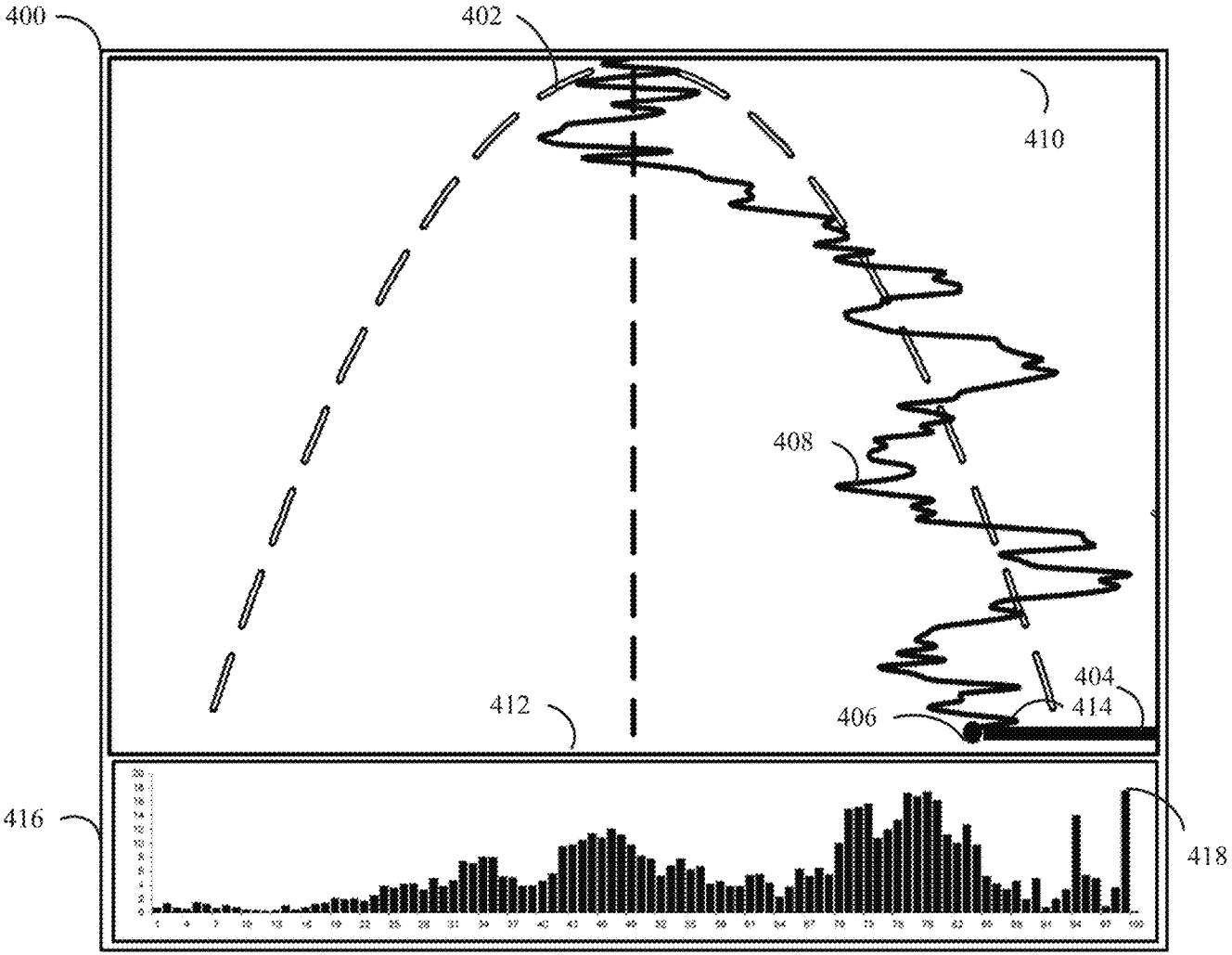

FIG. 4 illustrates a frame 400 that depicts an example field of play, a confidence interval 402 that is the 95% confidence interval for the horizontal location of the game object at each step during a round of play, a user-selected region 404 in the playing field, and a game disc 406 traversing a random path 408 over multiple steps from a start area 410 at the top of the playing field to an end area 412 at the bottom of the playing field. The system 100 displays the game's playing field, receives the user's selection of a region within the playing field, evaluates a probability that the object will traverse the user-selected region during any of the random movements by the object from a beginning area to an ending area during a round of play, and displays the object moving in the playing field during some of the object's random movements. For example, the display screen of the smartphone 102 displays the computer game's playing field, receives the player's selection of a small region close to the lower right of the playing field, and receives the player's wager of $2.00. Continuing the example, the gaming application 116 estimates a 10% probability that the game disc 406 will traverse the user's selected lower right-region 404 during any of the game disc's random movements 408 from the beginning at the top of the field 410 to the ending at the bottom of the field 412 during the round of play. Further to the example, the display screen of the smartphone 102 displays the 10% probability that the game disc 406 will traverse the user's selected lower right region 404 and the $20.00 that the player will win if the game disc 406 traverses the user's selected lower right region 404, and displays the game disc 406 moving in the field during the game disc's random movements 408.

As the game disc 406 zig-zags towards the user-selected lower right region 404, the player may naturally conclude that the probability of success is increasing. However, the player cannot precisely appreciate just how likely that a successful outcome will result, based on this visual representation of the event, because the player cannot translate this qualitative knowledge into a quantified amount. Therefore, the gaming application 116 continuously evaluates the changing real-time expected value of a successful traversal throughout the round of play.

After displaying some random movements by the object, an intermediate probability can be evaluated that the object will traverse the user-selected region during any intermediate random movements from the current location of object to the ending area of the field of play during the round of play. For example and without limitation, this may include the gaming application 116 estimating a 88.15% probability that the game disc 406 will traverse the user's selected lower right region 404 by any of the game disc's random movements from the game disc's current location 414 to the end area 412 at the bottom of the playing field during the round of play. An intermediate probability can be the extent to which an event is likely to occur, measured by the ratio of the favorable cases to the whole number of cases possible, with the measuring coming between two things in time, place, and/or order. An intermediate random movement can be a chaotic, haphazard motion that occurs between two things in time, place, and/or order. A current location can be a particular place or position that is associated with the present time.

If an intermediate probability is evaluated, the user interface can output an intermediate success value, based on the intermediate probability and a wager value, as an intermediate game option. By way of example and without limitation, this may include the display screen of the smartphone 102 displaying the $17.63 that the player will receive if the player selects the intermediate cash-out option, with the $17.63 based on the 88.15% probability that the game disc 406 will traverse the user's selected lower right region 404 and the $20.00 that the player will win if the game disc 406 traverses the user's selected lower right region 404 during any of the game disc's random movements 408 from the game disc's current location 414 to the end area 412 at the bottom of the field. FIG. 4 depicts a bar graph 416 that illustrates the changing expected value of the wager. The expected value starts out fluctuating around a value of $2.00 (based on a wager of $2.00, the initial 10% success probability, and a value multiplier of 10.0), the expected value increases in value and fluctuates dramatically, reaching a maximum value of $17.63 (based on the wager of $2.00, the current 88.15% success probability, and the value multiplier of 10.0), until the expected value ultimately decreases to $0.00 in response to an unsuccessful near miss. An intermediate success value can be the numerical amount denoted by an algebraic term; a magnitude, quantity, or number that is based on the accomplishment of an aim or purpose, with the denotation occurring between two things in time, place, and/or order. An intermediate game option can be something that may be chosen during a form of play or sport, with the choosing coming between two things in time, place, and/or order.

If an intermediate game option is output, a determination can be made whether the intermediate game option is selected. In embodiments, this may include the gaming application 116 determining that the player selected the intermediate game option to receive the $17.32 intermediate success value rather than continuing to play the round of play to its expected conclusion. If an intermediate game option is selected, the intermediate success value is optionally credited to the player of the game of chance. For example and without limitation, this may include the gaming application 116 crediting the player with the $17.32 intermediate success value because the player selected the intermediate game option to receive the $17.32 intermediate success value rather than continuing to play the round of play to its expected conclusion.

The user interface (button, touch screen interaction, voice activation, etc) enables a player to pause the progression of a round of play whenever the game disc 404 moves to an area of interest within the playing field. Alternatively, or additionally, the player can use the user interface to input a pre-determined threshold value for pausing the round of play (either by entering a value or by selecting an area within the field of play that corresponds to a particular value range), based on a threshold at which the player becomes interested in accepting an intermediate offer. This threshold assists a player who lacks quick hand-eye coordination in pausing the round of play, which enables the player to let the round of play continue while the round of play is less interesting for the player. If the intermediate payouts get within the player's range of interest, the round of play will pause, and enable the player to progress the round of play more slowly. For example, the player can insert an "indicator" onto the bar graph 416 which marks the value above which the round of play will automatically pause. This enables the player to assess whether or not the player wants to accept the current offer or to allow the round of play to continue. The ability to assess the changing real-time expected value of a wager and to potentially receive any of the changing offers prior to the expected conclusion of the round of play creates more excitement for the player. Since the real-time expected value of the wager is an exact calculation of the value underlying that excitement, the gaming application 116 creates another game within the original game, enabling the player to guess where the wager will attain its maximal value rather than always waiting for the round of play to play out to its expected conclusion, which on average will be lower than the maximal value during the round of play.

If the intermediate game option is not selected, more random movements by the object are displayed, and a determination is made whether the object traversed the user-selected region during any of the random movements. By way of example and without limitation, this may include the gaming application 116 determining whether the game disc 406 traversed the user's selected lower right region 404 during any of the game disc's random movements 408. In contrast to the wagers that are only successful or unsuccessful for the Galton box, craps, roulette, and slot machines, the gaming application 116 provides the opportunity for a player to receive something for a wager that would have been unsuccessful. In this example, the gaming application 116 translates what ultimately would have become an otherwise unsuccessful wager into an opportunity to receive payouts ranging from $0.00 to $17.63. If the object traversed the user-selected region during any of the random movements, a success value is credited, based on the successful traversal probability, to a player of the game of chance. In embodiments, this may include the gaming application 116 crediting $20.00 to the player, based on the 10% probability (or 1 success in 10 chances, which results in a value multiplier of 10.0) and the player's $2.00 wager, because the game disc 406 traversed the user's selected lower right region 404 during at least one of the game disc's random movements 408 in the round of play. If the object did not traverse the user-selected region during any of the random movements, the player of the game of chance can be debited the wager value. For example and without limitation, this may include the gaming application 116 taking the $2.00 wager from the player because the game disc 406 did not traverse the user's selected lower right region 404 during any of the game disc's random movements 408 during the round of play.

Figure 5:
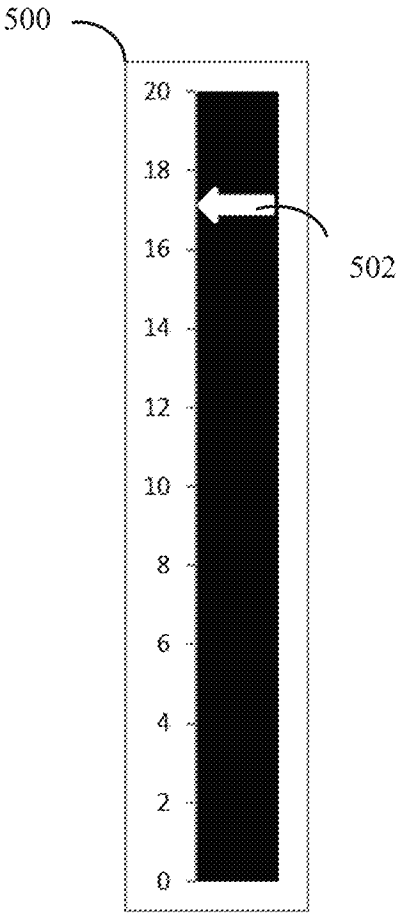

In addition to the bar graph 416 in FIG. 4, the user interface can output the real-time expected value of a wager in other ways, such as a digital display, or various gauges, whether they be circular, linear (horizontal or vertical [similar to a thermometer]), or arched (similar to an old-fashioned speedometer with a needle that bounces left and right across an arch). FIG. 5 illustrates a frame 500 that includes a generic graphical representation of a gauge. As the round of play commences, the arrow 502, which designates the expected value offer, fluctuates in accordance with the changing expected value of the wager. If the expected value offer attains a value of interest to the player, the player can temporarily pause the round of play and decide whether or not to accept the offer. If the player decides to accept the offer, the round of play ends and the player receives the expected value. If the player decides to reject the offer, the round of play will resume and the expected value offer will again fluctuate until the player either accepts one of the subsequent offers or the round of play ends.

Figure 6:
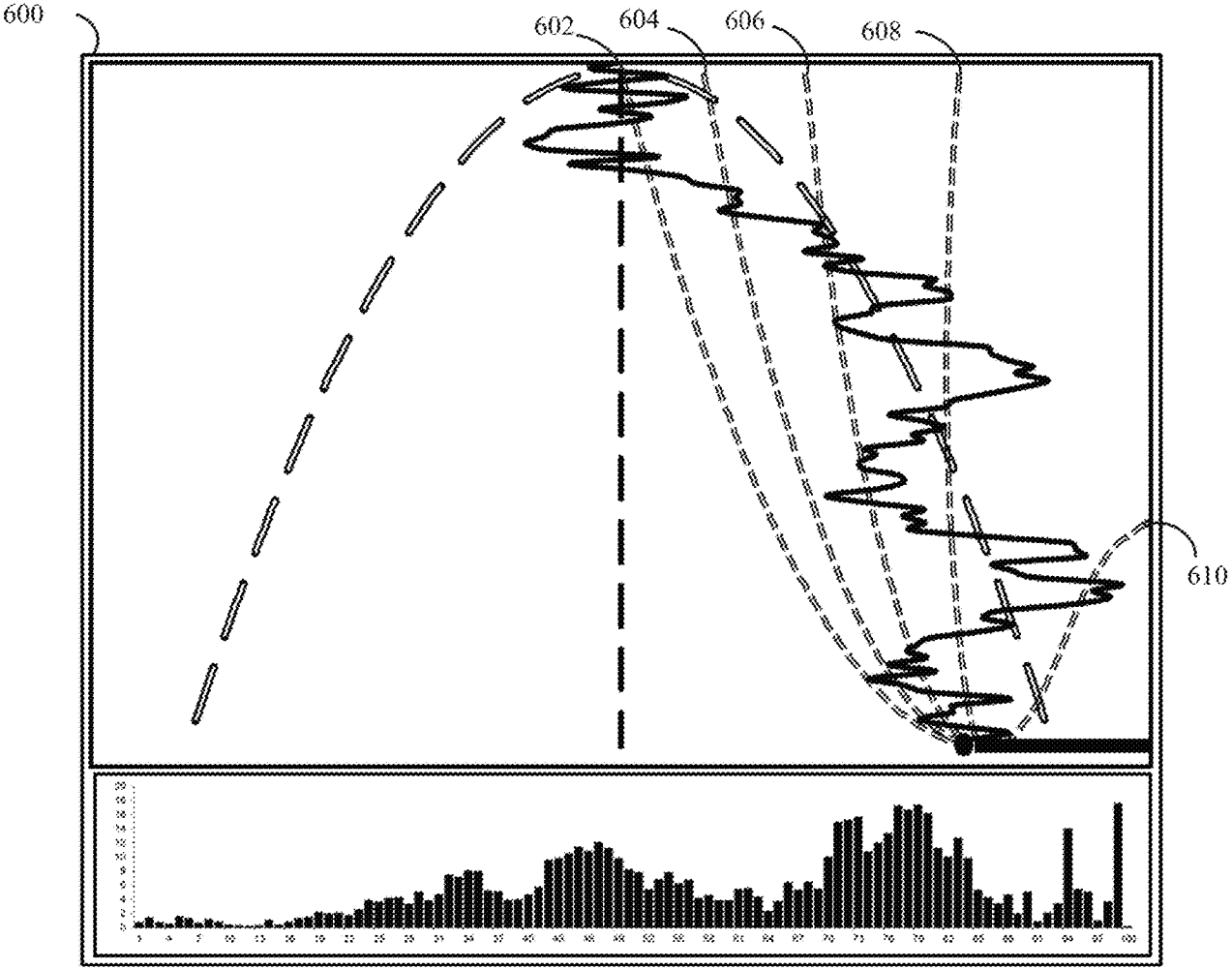

Instead of requiring the player to take their eyes off the playing field to become informed of the changes in the expected value of the wager, the gaming application 116 can output graphical cues within the playing field to indicate locations where the expected value of the wager is equal to a particular value if the random movement object appears in that location. FIG. 6 illustrates a frame 600 that depicts these graphical cues as dashed lines, with the dashed lines that are located more centrally representing areas of lower value. The first dashed line 602 represents the locations where the expected value is equal to a value multiplier of 1.0, and each successive line represents a doubling of the value multipliers to 2.0 for the second dashed line 604, 4.0 for the third dashed line 606, 8.0 for the fourth dashed line 608, and 16.0 for the fifth dashed line 610. When a player selects only one region for traversal by the random movement object, these single-colored lines 602-610 enable the player to easily appreciate the increases and decreases of the expected value of the wager.

However, if the player selected multiple regions in the playing field, graphical cues bashed on dashed lines may not be applicable. Therefore, the gaming application 116 may use a color-coding scheme to represent areas where the expected value of a wager takes on a particular value. The gaming application 116 may color-code either lines or areas within the playing field to represent the changing expected values for a user's multiple selected regions. For example, a particular color might represent a range of values, and a spectrum of hues may be used to categorize values within that range. Alternatively, the gaming application 116 may use wavelengths of the various colors in the visible electromagnetic spectrum to represent the entire range of possible payouts from zero to the maximum possible expected value.

The gaming application 116 may also enable aggregate wagers, whereby a player makes a single wager with multiple possible payout possibilities. A game of chance processes an aggregate wager as a set of multiple wagers, where a defined percentage of the value wagered is assigned to the outcomes associated with each of the value multipliers. For example, a hypothetical aggregate wager for a slot machine with true odds payout (the mean return on amount wagered is 100%) includes assigning 4.17% of a wager's value to an outcome associated with the smallest non-zero value multiplier, and assigning 2.08% of the wager's value to an outcome associated with a the largest value multiplier, with additional percentages of the wager's value assigned to additional outcomes that are each associated with value multipliers that are larger than the smallest non-zero value multiplier and smaller than the largest value multiplier. The aggregate wagers of slot machines include "jackpots" with large payouts that can be life-changing in magnitude. Although the likelihood of winning a jackpot is very low, the possibility that it can happen provides a level of excitement for the player, and a sufficient frequency of outcomes with lower payouts are included to maintain the player's interest and keep the player playing the slot machines. With slot machines, design experts must use mathematical expertise to achieve the desired payout distributions, which are the correct distribution of probabilities that correspond to the different outcomes. However, the gaming application 116 eliminates the need for an expert game designer to predetermine values for aggregate wagers. Instead, a player can simply dictate multiple wagers with any desired probability of occurrence, thereby allowing the construction of aggregate wagers with any theoretical payout distribution.

Figure 7:
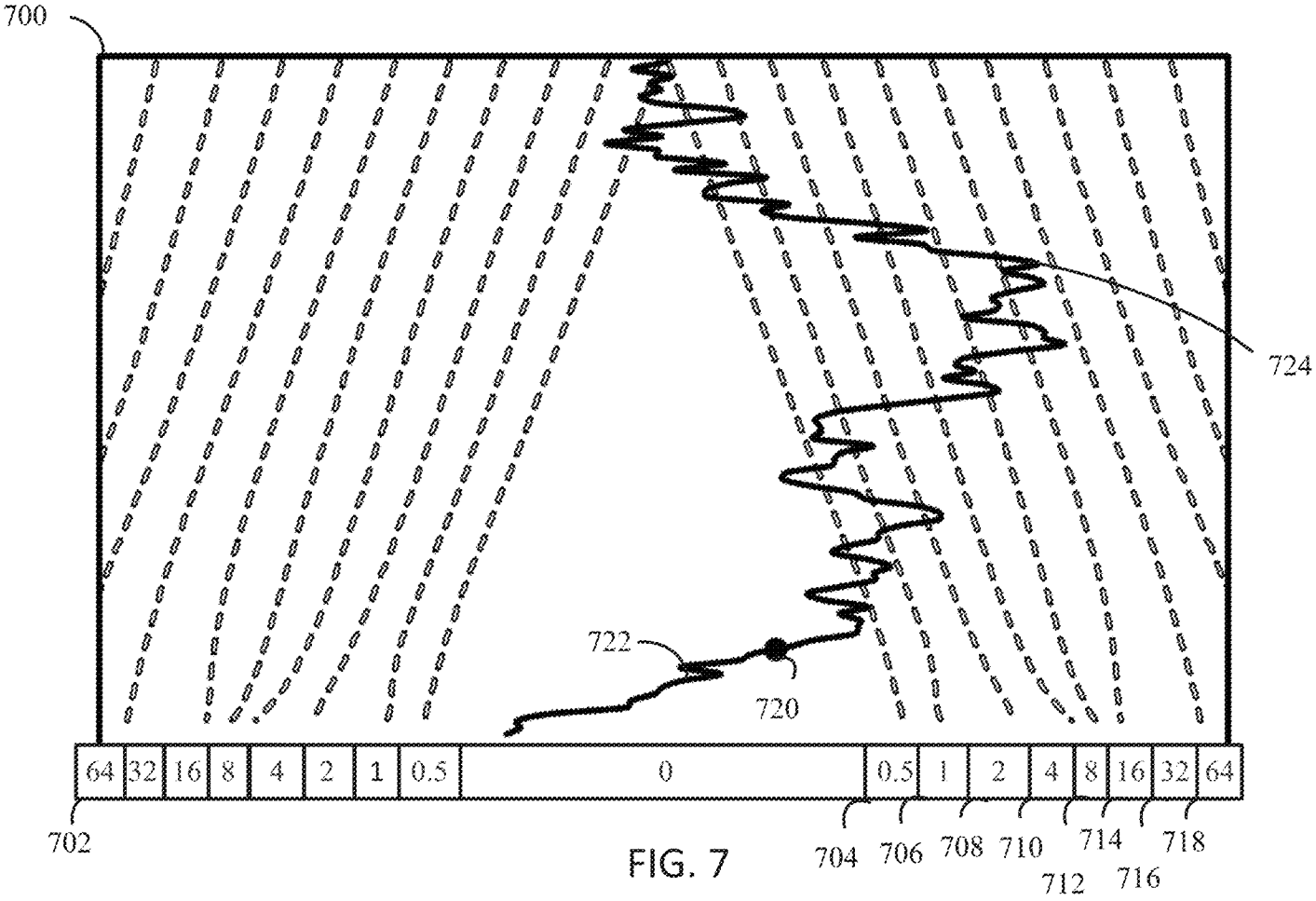

FIG. 7 illustrates a frame 700 that depicts an aggregate wager. The aggregate wager's regions for value multipliers 702 are aligned along the bottom of the playing field and are positioned in a symmetrical fashion, such that the smallest value multipliers are the closest to the center of the playing field and the successively larger value multipliers are located next to the previous value multipliers, as the dashed lines proceed to the periphery in both directions. This results in a symmetrical arrangement of dashed lines representing increasing value multipliers as the dashed lines proceed from the center of the playing field to the periphery of the playing field. For example, the first dashed line 704, which is close to the center, represents where the value multiplier equals to 0.50, the second dashed line 706 represents where the value multiplier equals to 1.00, the third dashed line 708 represents where the value multiplier equals to 2.00, the fourth dashed line 710 represents where the value multiplier equals to 4.00, the fifth dashed line 712 represents where the value multiplier equals to 8.00 the sixth dashed line 714 represents where the value multiplier equals to 16.00, the seventh dashed line 716 represents where the value multiplier equals to 32.00 the eighth dashed line 718 represents where the value multiplier equals to 64.00, etc.

As the game disc 720 traverses the playing field and approaches the regions for value multipliers 702, the player will likely become excited when the game disc 720 moves towards the periphery where the larger value multipliers are located. However, the player's excitement is instinctual because the human mind cannot accurately calculate how excited the player should become. The updated expected value offer, which is the real-time expected value for the wager, is an exact calculation of the value underlying that excitement, which enables the player to decide whether or not to cash in on that excitement.

After displaying some random movements by the object, an intermediate probability can be evaluated that the object will traverse specific regions corresponding to specific value multipliers 702 during any intermediate random movements from the current location of object to the ending area during the round of play. Then the user interface can output an intermediate success value, based on the intermediate probability and a wager value, as an intermediate game option. If the intermediate game option is selected, the intermediate success value can be credited to the player of the game of chance.

For example, the gaming application 116 estimates the currently expected success value of $26.73 based on a 28.5% probability that the game disc 720 will traverse the region for the value multiplier 32.0, a 28.5% probability that the game disc 720 will traverse the region for the value multiplier 16.0, a 14.3% probability that the game disc 720 will traverse the region for the value multiplier 64.0, a 14.3% probability that the game disc 720 will traverse the region for the value multiplier 8.0, a 7.1% probability that the game disc 720 will traverse the region for the value multiplier 128.0, a 7.1% probability that the game disc 720 will traverse the region for the value multiplier 4.0, and a wager value of $0.80. The maximum expected value of $26.73 occurs at the round of play step 724. Continuing the example, the display screen of the smartphone 102 displays the $26.73 that the player will receive if the player selects the intermediate game option. Further to this example, the gaming application 116 credits the player with the $26.73 intermediate success value because the player selected the intermediate game option to receive the $26.73 intermediate success value rather than continuing to play the round of play to its expected conclusion.

The user interface (button, touch screen interaction, voice activation, etc) enables the player to pause the progression of the round of play whenever the game disc 720 moves to an area of interest within the playing field. This enables the player to assess whether or not the player wants to accept the current offer or to allow the round of play to continue. The ability to assess the changing real-time expected value of a wager and to potentially receive any of the changing offers prior to the expected conclusion of the round of play creates more excitement for the player. Since the real-time expected value of the wager is an exact calculation of the value underlying that excitement, the gaming application 116 creates another game within the original game, enabling the player to guess where the wager will attain its maximal value rather than always waiting for the round of play to play out to its conclusion, which on average will be lower than the maximal value during the round of play.

If the intermediate game option is not selected, more random movements by the object are displayed, and a success value is credited, based on the probability, to a player of the game of chance if the object traversed a designated region corresponding to a non-zero value multiplier. For example, the gaming application 116 credits $3.20 to the player, based on the 25% probability (or 1 success in 4 chances, which results in a value multiplier of 4.0) and the player's $0.80 wager, because the game disc 720 traversed the region that corresponds to the value multiplier of 4.0 during the game disc's random movements 724 in the round of play. If the object did not traverse the designated region that corresponds to a non-zero value multiplier during the random movements 724 in the round of play, the player of the game of chance can be debited the wager value. For example, the gaming application 116 takes the $0.80 wager from the player because the game disc 720 traversed the designated region that corresponds to the value multiplier of 0.

Figure 8:
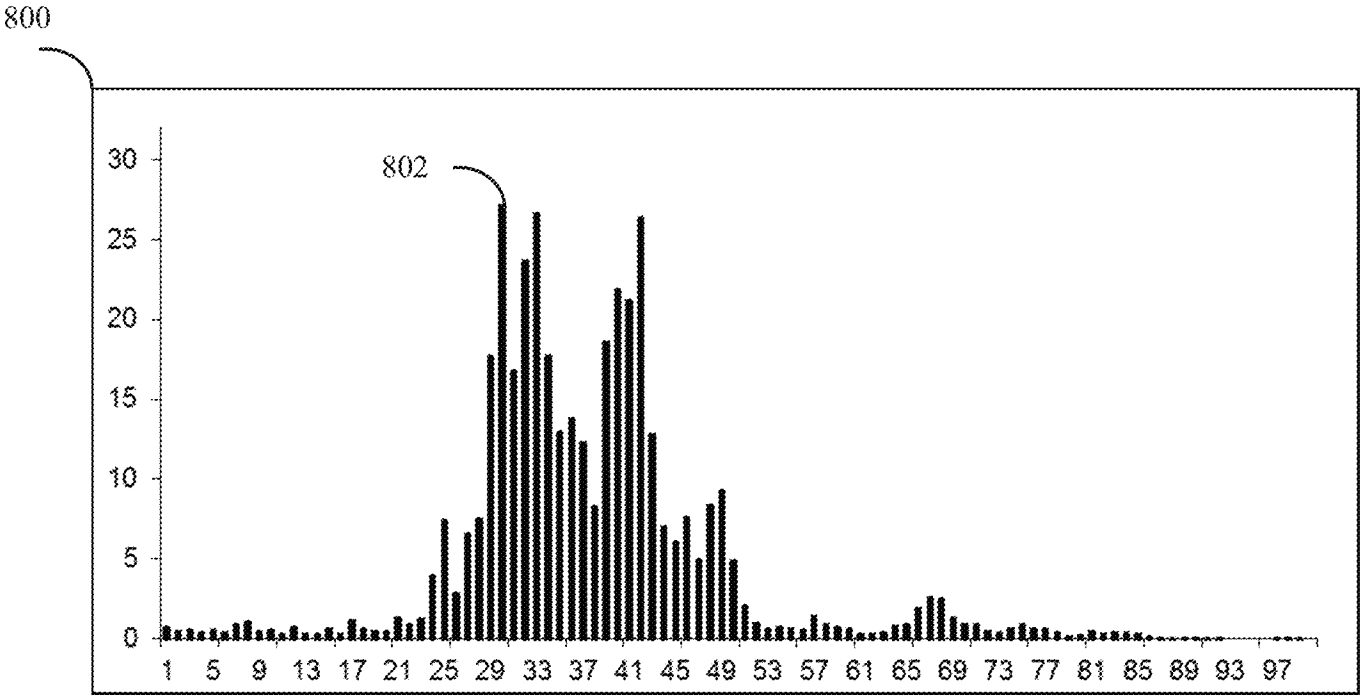

The gaming application 116 can use a continuous probability distribution to easily create and implement aggregate wagers with any desired distribution of value multipliers, thereby providing a selection of predefined aggregate wagers from which a player can select, and/or enable the player to modify or create aggregate wagers with their personal preferences. FIG. 8 illustrates a frame 800 that depicts a graph of the expected value for FIG. 7's aggregate wager. The frame 800 depicts the maximum expected value of $26.73 800, which corresponds to the round of play step 724 that is depicted in FIG. 7.

Figure 9:
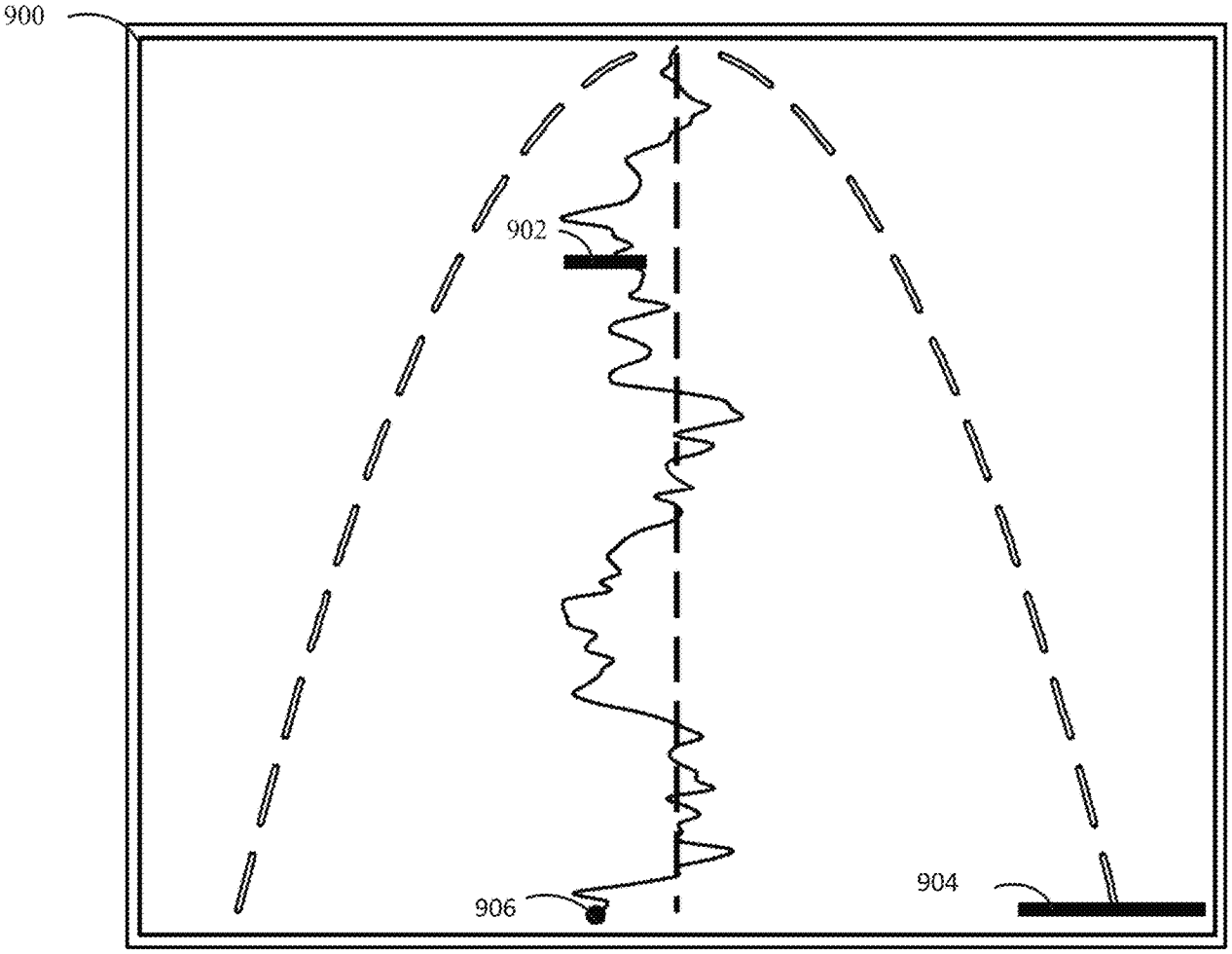

The gaming application 116 provides various games that enable players to select multiple sections for traversal by the random movement object. For example, FIG. 9 depicts a frame 900 that includes the regions 902 and 904 that the player selected. When the player selects multiple regions, the gaming application 116 provides the option for the player to define success as occurring when the random movement object traverses at least one of the player's selected regions, when the random movement object traverses all of the user's selected regions, or when the random movement object traverses any combination of the user's selected regions. A definition of success that requires the random movement object to traverse all of the user's selected regions may be referred to as a "parlay wager." The probability of success will decrease as the number of user-selected regions increases, these user-selected regions are placed in less probable locations within the field of play, or these user-selected regions are placed further apart from one another. However, a lower probability of success will result in a larger value multiplier. For example, since the gaming application 116 evaluates a 20% probability that the game disc 906 traverses the region 902 and evaluates a 10% probability that the game disc 906 traverses the region 904, the gaming application 116 evaluates a 28% probability that the game disc 906 traverses either the region 902 or the region 904, thereby resulting in a value multiplier of 3.57 for a successful traversal, and evaluates a 2% probability that the game disc 906 traverses both the region 902 and the region 904, thereby resulting in a value multiplier of 50.0 for a successful traversal. Although these simplified combined probability calculations are based on the premise that the underlying component probabilities are independent of each other, the actual combined probability calculations could be more complex. The actual combined probability calculations would be acutely dependent on the relative positions of the corresponding regions. Directly above one another, two regions will virtually always be traversed together. For regions that are on opposite sides of the playing field and/or further apart vertically, the combined probability can drop immensely.

Figure 10:
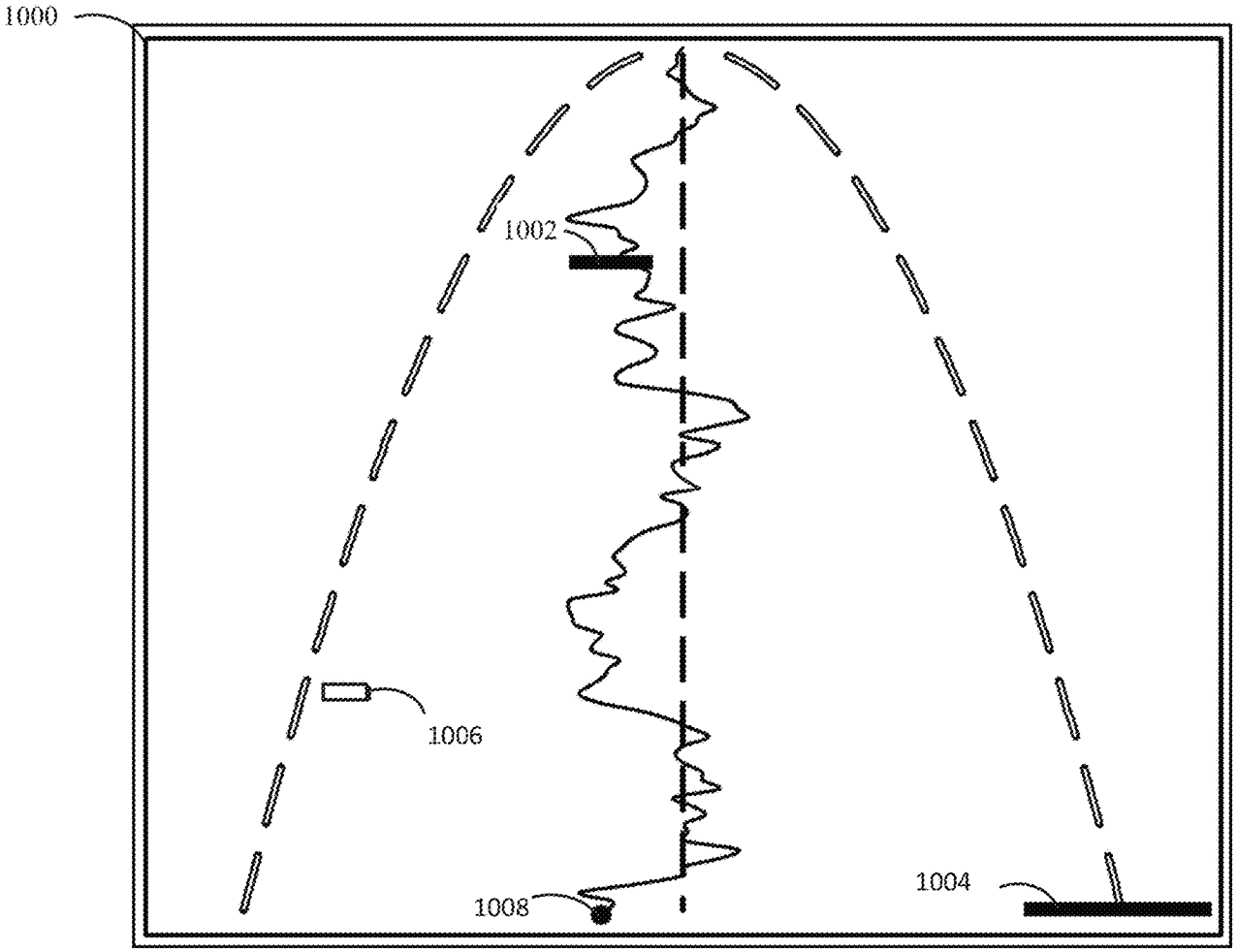

The gaming application 116 can provide a game that enables players to simulate a "place bet," which is a popular wager in the game of craps. For example, a craps player may bet that the rolling of two dice will result in the outcome of a 6 or the outcome of a 9 before the outcome of a 7. The gaming application 116 enables a player to simulate a craps "place" bet that the rolling of two dice will result in the outcome of 6 or the outcome of a 9 before the outcome of a 7, or place any type of bet, such as a bet that the rolling of two dice will result in the outcome of 7 or the outcome of a 9 before the outcome of an 11. Since this game is not as simple as dice, the particular "rules" for this bet that mimics a place bet can be implemented in a few different ways. FIG. 10 depicts a frame 1000 that includes the black region 1002, which has the same probability of being traversed as two dice rolling has in producing the outcome of a 7, the black region 1004, which has the same probability of being traversed as two dice rolling has in producing the outcome of a 9, and the white region 1006, which has the same probability of being traversed as two dice rolling has in producing the outcome of an 11. The place bet in craps is a multi-roll bet. Therefore, this game is an example of a multi-round wager. If either or both of the black regions 1002 and 1004 (which represent the player) are traversed by the game disc 1008 and the white region 1006 is not traversed by the game disc 1008, the player wins the payout associated with the respective winning wager(s), as in the game of craps. However, if the game disc 1008 traverses the white region 1006 during a round of play, the player loses both wagers, as in the game of craps. If the game disc 1008 fails to pass through any of the regions 1002-1006, the wager continues to the next round of play, or the player can take down their wager after any round of play, as in the game of craps. However, in this game it is possible for all three of the outcomes to be selected, which is different from the game of craps. In this situation, the wager will result in a push, which means that the player neither receives nor loses any value. This wager, which mimics a place bet in craps, is not restricted to the probabilities associated with craps. Any desired probabilities (which are based on the width and locations of the user-selected regions) can be selected for the black and white regions. In addition, the player can place the black and white regions anywhere the player desires within the playing field (the gaming application 116 will adjust the widths appropriately to maintain the desired probabilities), which increases the sense of control in the outcome, which is a desirable feature. The payout value for this type of wager will be influenced by the relative probabilities of success for the white and black regions, which will be influenced by the sizes and locations of their corresponding regions. In addition to the random movements of an object in a two-dimensional playing field, the gaming application 116 can provide games in which the object moves in three or more dimensions in a playing field, which can be any shape, such as a rectangle, a triangle, a circle, or any amorphous shape.

FIGS. 2-10 illustrate frames 200, 300, 400, 500, 600, 700, 800, 900, and 1000 of example user interface screens of devices for a computer game of chance, in an embodiment. The frames 200-1000 may be part of larger display screens that includes fields for users to enter commands to create, retrieve, edit, and store information. Because the frames 200-1000 are samples, the frames 200-1000 could vary greatly in appearance. For example, the relative sizes and positioning of the graphical images are not important to the practice of the present disclosure. The frames 200-1000 can be depicted by any visual displays, but are preferably depicted by computer screens. The frames 200-1000 could also be output as reports and printed or saved in electronic formats, such as PDF. The frames 200-1000 can be part of a personal computer system and/or a network, and operated from system data received by the network, and/or on the Internet. The frames 200-1000 may be navigable by a user. Typically, a user can employ a touch screen input, voice command, or a mouse input device to point-and-click to locations on the frames 200-1000 to manage the graphical images on the frames 200-1000. Alternately, a user can employ directional indicators, or other input devices such as a keyboard. The graphical images depicted by the frames 200-1000 are examples, as the frames 200-1000 may include much greater amounts of graphical images. The frames 200-1000 may also include fields in which a user can input information.

Figure 11:
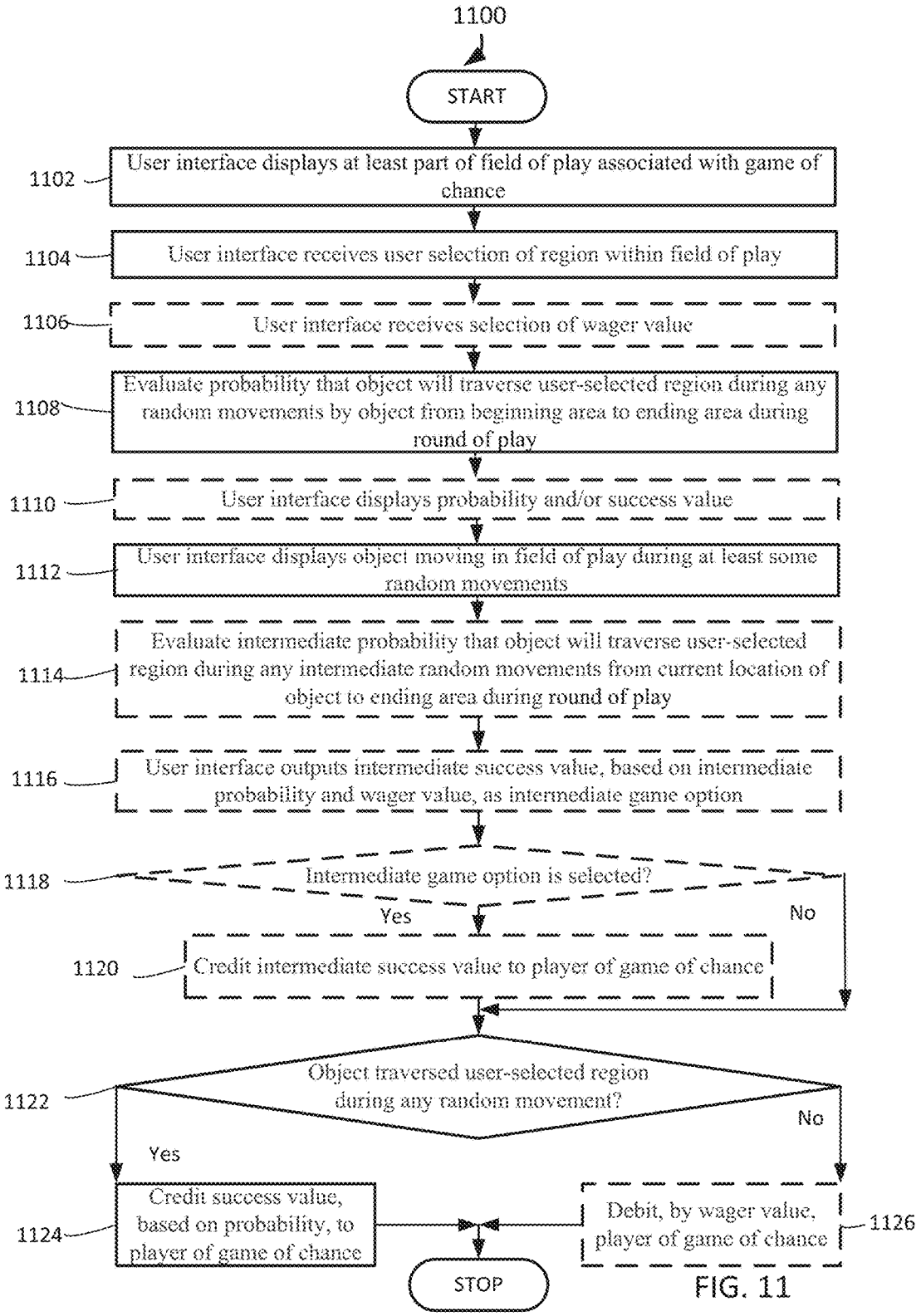
FIG. 11 is a flowchart that illustrates a computer-implemented method for a computer game of chance, under an embodiment.

FIG. 11 is a flowchart that illustrates a computer-implemented method for a computer game of chance, under an embodiment. Flowchart 1100 illustrates method acts illustrated as flowchart blocks for certain actions involved in and/or between the system elements 102-112 of FIG. 1.

A user interface displays at least a part of a field of play associated with a game of chance, block 1102. The system 100 displays the game's playing field. For example and without limitation, this may include the display screen of the smartphone 102 displaying a computer game's field of play.

Having displayed the playing field, the user interface receives a user selection of a region within the field of play, block 1104. The system 100 receives the user's selection of a region in the game's playing field. By way of example and without limitation, this may include the user interface of the smartphone 102 receiving the player's selection of a small region close to the upper middle of the field of play.

Along with the user's selection of the region, the user interface optionally receives a selection of a wager value, block 1106. The system 100 can receive a player's wager. In embodiments, this may include the user interface of the smartphone 102 receiving the player's wager of $2.00.

After receiving the user's selection of the region, a probability is evaluated that an object will traverse the user-selected region during any of the random movements by the object from a beginning area to an ending area during a round of play, block 1108. The system 100 evaluates a successful traversal probability. For example and without limitation, this may include the gaming application 116 estimating a 20% probability that a game disc will traverse the user's selected region during any of the game disc's random movements from the beginning at the top of the field to the ending at the bottom of the field during a round of play.

Having evaluated the probability of successful traversal, the user interface optionally displays the probability and/or a success value, block 1110. The system 100 can output the successful traversal probability. By way of example and without limitation, this may include the display screen of the smartphone 102 displaying the 20% probability that the game disc will traverse the player's selected region and the $10.00 that the player will win if the game disc traverses the player's selected region.

Following the evaluation of the successful traversal probability, the user interface displays the object moving in the field of play during at least some of the random movements, block 1112. The system 100 displays a round of play. In embodiments, this may include the display screen of the smartphone 102 displaying the game disc moving in the playing field during the game disc's random movements.

After displaying some random movements by the object, an intermediate probability is optionally evaluated that the object will traverse the user-selected region during any intermediate random movements from the current location of object to the ending area during the game of chance, block 1114. The system 100 can evaluate an intermediate successful traversal probability. For example and without limitation, this may include the gaming application 116 estimating a 88.15% probability that the game disc will traverse the player's selected region by any of the game disc's random movements from the game disc's current location to the ending at the bottom of the field during the round of play.

If an intermediate probability is evaluated, the user interface optionally outputs an intermediate success value, based on the intermediate probability and a wager value, as an intermediate game option, block 1116. The system 100 can output an intermediate success value as an offer. By way of example and without limitation, this may include the display screen of the smartphone 102 displaying the 88.15% probability that the game disc will traverse the user's selected region and the $17.32 that the player can receive if the player selects the intermediate game option.

If an intermediate game option is output, a determination is optionally made whether the intermediate game option is selected, block 1118. The system 100 can determine if the player wants to receive the intermediate success value. In embodiments, this may include the gaming application 116 determining that the player selected the intermediate game option to receive the $17.32 intermediate success value rather than continuing to play the round of play to its expected conclusion. If the intermediate game option is selected, the flowchart 1100 continues to block 1120. If the intermediate game option is not selected, the flowchart 1100 proceeds to block 1122.

If an intermediate game option is selected, the intermediate success value is optionally credited to the player of the game of chance, block 1120. The system 100 can credit the player with the intermediate success value. For example and without limitation, this may include the gaming application 116 crediting the player with the $17.32 intermediate success value because the player selected the intermediate game option to receive the $17.32 intermediate success value rather than continuing to play the round of play to its expected conclusion.

After displaying random movements by the object, a determination is made whether the object traversed the user-selected region during any of the random movements, block 1122. The system 100 determines if a successful traversal occurred. By way of example and without limitation, this may include the gaming application 116 determining whether the game disc traversed the user's selected region during any of the game disc's random movements. If the object traversed the user-selected region during any of the random movements, the method continues to block 1122. If the object did not traverse the user-selected region during any of the random movements, the method proceeds to block 1124.

If the object traversed the user-selected region during any of the random movements, a success value is credited, based on the probability, to a player of the game of chance, block 1124. The system 100 rewards the player for a successful round of play. In embodiments, this may include the gaming application 116 crediting $10.00 to the player, based on the 20% probability (or 1 success in 5 chances, which results in a value multiplier of 5) and the player's $2.00 wager, because the game disc traversed the user's selected region during at least one of the game disc's random movements in the round of play. Then the flowchart 1100 terminates.

If the object did not traverse the user-selected region during any of the random movements, the player of the game of chance is optionally debited the wager value, block 1126. The system 100 can debit the player for an unsuccessful round of play. For example and without limitation, this may include the gaming application 116 taking the $2.00 wager from the player because the game disc did not traverse the user's selected region during any of the game disc's random movements during the round of play.

Although FIG. 10 depicts the blocks 1102-1126 occurring in a specific order, the blocks 1102-1126 may occur in another order. In other implementations, each of the blocks 1102-1126 may also be executed in combination with other blocks and/or some blocks may be divided into a different set of blocks.

Figure 12:
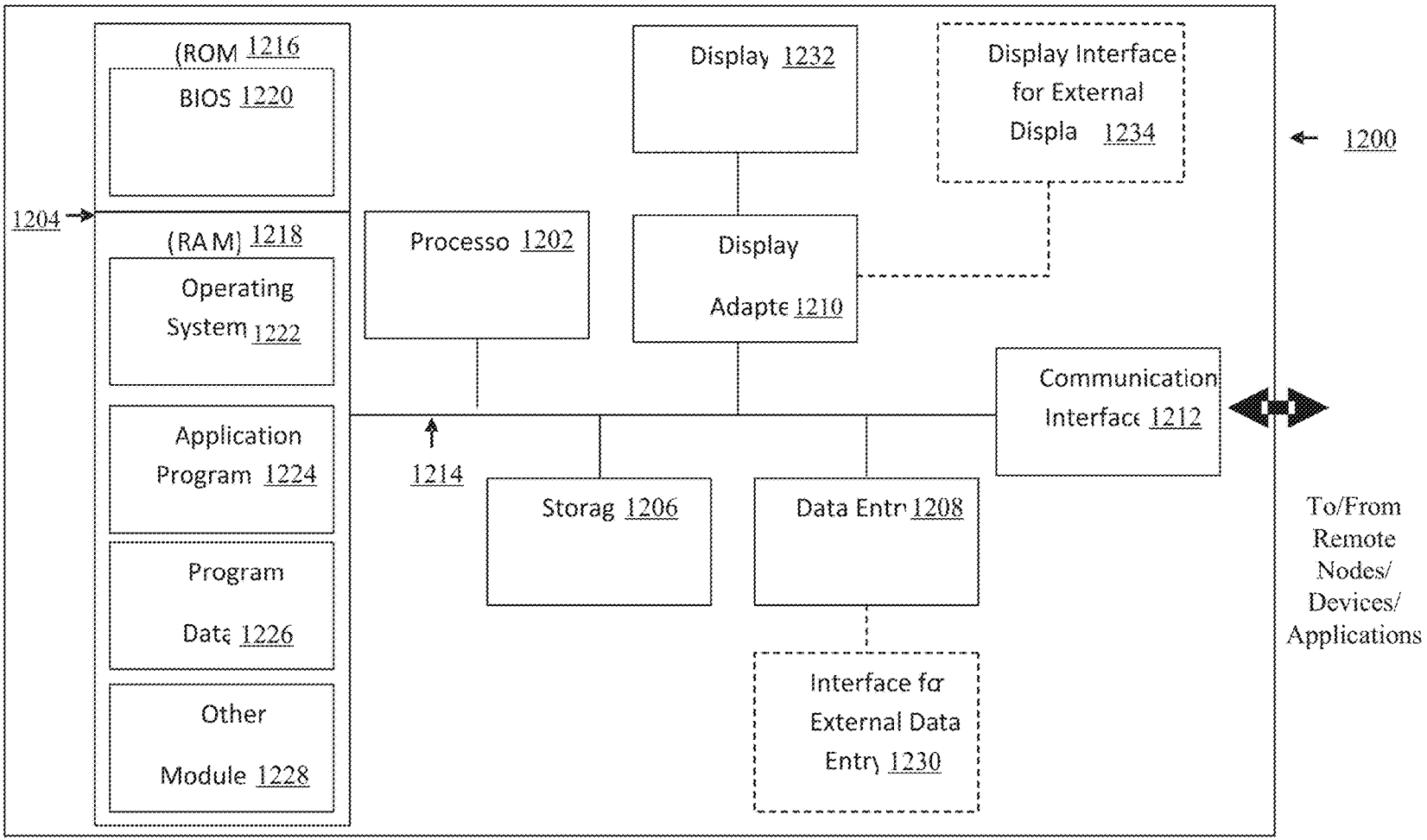
FIG. 12 is a block diagram illustrating an example hardware device in which the subject matter may be implemented.

An exemplary hardware device in which the subject matter may be implemented shall be described. Those of ordinary skill in the art will appreciate that the elements illustrated in FIG. 12 may vary depending on the system implementation. With reference to FIG. 12, an exemplary system for implementing the subject matter disclosed herein includes a hardware device 1200, including a processing unit 1202, a memory 1204, a storage 1206, a data entry module 1208, a display adapter 1210, a communication interface 1212, and a bus 1214 that couples elements 1204-1212 to the processing unit 1202.

The bus 1214 may comprise any type of bus architecture. Examples include a memory bus, a peripheral bus, a local bus, etc. The processing unit 1202 is an instruction execution machine, apparatus, or device and may comprise a microprocessor, a digital signal processor, a graphics processing unit, an application specific integrated circuit (ASIC), a field programmable gate array (FPGA), etc. The processing unit 1202 may be configured to execute program instructions stored in the memory 1204 and/or the storage 1206 and/or received via the data entry module 1208.

The memory 1204 may include a read only memory (ROM) 1216 and a random access memory (RAM) 1218. The memory 1204 may be configured to store program instructions and data during operation of the hardware device 1200. In various embodiments, the memory 1204 may include any of a variety of memory technologies such as static random access memory (SRAM) or dynamic RAM (DRAM), including variants such as dual data rate synchronous DRAM (DDR SDRAM), error correcting code synchronous DRAM (ECC SDRAM), or RAMBUS DRAM (RDRAM), for example. The memory 1204 may also include nonvolatile memory technologies such as nonvolatile flash RAM (NVRAM) or ROM. In some embodiments, it is contemplated that the memory 1204 may include a combination of technologies such as the foregoing, as well as other technologies not specifically mentioned. When the subject matter is implemented in a computer system, a basic input/output system (BIOS) 1220, containing the basic routines that help to transfer information between elements within the computer system, such as during start-up, is stored in the ROM 1216.

The storage 1206 may include a flash memory data storage device for reading from and writing to flash memory, a hard disk drive for reading from and writing to a hard disk, a magnetic disk drive for reading from or writing to a removable magnetic disk, and/or an optical disk drive for reading from or writing to a removable optical disk such as a CD ROM, DVD or other optical media. The drives and their associated computer-readable media provide nonvolatile storage of computer readable instructions, data structures, program modules and other data for the hardware device 1200.

It is noted that the methods described herein may be embodied in executable instructions stored in a computer readable medium for use by or in connection with an instruction execution machine, apparatus, or device, such as a computer-based or processor-containing machine, apparatus, or device. It will be appreciated by those skilled in the art that for some embodiments, other types of computer readable media may be used which may store data that is accessible by a computer, such as magnetic cassettes, flash memory cards, digital video disks, Bernoulli cartridges, RAM, ROM, and the like may also be used in the exemplary operating environment. As used here, a "computer-readable medium" may include one or more of any suitable media for storing the executable instructions of a computer program in one or more of an electronic, magnetic, optical, and electromagnetic format, such that the instruction execution machine, system, apparatus, or device may read (or fetch) the instructions from the computer readable medium and execute the instructions for carrying out the described methods. A non-exhaustive list of conventional exemplary computer readable medium includes: a portable computer diskette; a RAM; a ROM; an erasable programmable read only memory (EPROM or flash memory); optical storage devices, including a portable compact disc (CD), a portable digital video disc (DVD), a high definition DVD (HD-DVD™), a BLU-RAY disc; and the like.

A number of program modules may be stored on the storage 1206, the ROM 1216 or the RAM 1218, including an operating system 1222, one or more applications programs 1224, program data 1226, and other program modules 1228. A user may enter commands and information into the hardware device 1200 through data entry module 1208. The data entry module 1208 may include mechanisms such as a keyboard, a touch screen, a pointing device, etc. Other external input devices (not shown) are connected to the hardware device 1200 via an external data entry interface 1230. By way of example and not limitation, external input devices may include a microphone, joystick, game pad, satellite dish, scanner, or the like. In some embodiments, external input devices may include video or audio input devices such as a video camera, a still camera, etc. The data entry module 1208 may be configured to receive input from one or more users of the hardware device 1200 and to deliver such input to the processing unit 1202 and/or the memory 1204 via the bus 1214.

A display 1232 is also connected to the bus 1214 via the display adapter 1210. The display 1232 may be configured to display output of the hardware device 1200 to one or more users. In some embodiments, a given device such as a touch screen, for example, may function as both the data entry module 1208 and the display 1232. External display devices may also be connected to the bus 1214 via the external display interface 1234. Other peripheral output devices, not shown, such as speakers and printers, may be connected to the hardware device 1200.

The hardware device 1200 may operate in a networked environment using logical connections to one or more remote nodes (not shown) via the communication interface 1212. The remote node may be another computer, a server, a router, a peer device or other common network node, and typically includes many or all of the elements described above relative to the hardware device 1200. The communication interface 1212 may interface with a wireless network and/or a wired network. Examples of wireless networks include, for example, a BLUETOOTH network, a wireless personal area network, a wireless 802.11 local area network (LAN), and/or wireless telephony network (e.g., a cellular, PCS, or GSM network). Examples of wired networks include, for example, a LAN, a fiber optic network, a wired personal area network, a telephony network, and/or a wide area network (WAN). Such networking environments are commonplace in intranets, the Internet, offices, enterprise-wide computer networks and the like. In some embodiments, the communication interface 1212 may include logic configured to support direct memory access (DMA) transfers between the memory 1204 and other devices.

In a networked environment, program modules depicted relative to the hardware device 1200, or portions thereof, may be stored in a remote storage device, such as, for example, on a server. It will be appreciated that other hardware and/or software to establish a communications link between the hardware device 1200 and other devices may be used.

It should be understood that the arrangement of the hardware device 1200 illustrated in FIG. 12 is but one possible implementation and that other arrangements are possible. It should also be understood that the various system components (and means) defined by the claims, described below, and illustrated in the various block diagrams represent logical components that are configured to perform the functionality described herein. For example, one or more of these system components (and means) may be realized, in whole or in part, by at least some of the components illustrated in the arrangement of the hardware device 1200.

In addition, while at least one of these components are implemented at least partially as an electronic hardware component, and therefore constitutes a machine, the other components may be implemented in software, hardware, or a combination of software and hardware. More particularly, at least one component defined by the claims is implemented at least partially as an electronic hardware component, such as an instruction execution machine (e.g., a processor-based or processor-containing machine) and/or as specialized circuits or circuitry (e.g., discrete logic gates interconnected to perform a specialized function), such as those illustrated in FIG. 12.

Other components may be implemented in software, hardware, or a combination of software and hardware. Moreover, some or all of these other components may be combined, some may be omitted altogether, and additional components may be added while still achieving the functionality described herein. Thus, the subject matter described herein may be embodied in many different variations, and all such variations are contemplated to be within the scope of what is claimed.

In the descriptions above, the subject matter is described with reference to acts and symbolic representations of operations that are performed by one or more devices, unless indicated otherwise. As such, it is understood that such acts and operations, which are at times referred to as being computer-executed, include the manipulation by the processing unit of data in a structured form. This manipulation transforms the data or maintains it at locations in the memory system of the computer, which reconfigures or otherwise alters the operation of the device in a manner well understood by those skilled in the art. The data structures where data is maintained are physical locations of the memory that have particular properties defined by the format of the data. However, while the subject matter is described in a context, it is not meant to be limiting as those of skill in the art will appreciate that various of the acts and operations described hereinafter may also be implemented in hardware.

To facilitate an understanding of the subject matter described above, many aspects are described in terms of sequences of actions. At least one of these aspects defined by the claims is performed by an electronic hardware component. For example, it will be recognized that the various actions may be performed by specialized circuits or circuitry, by program instructions being executed by one or more processors, or by a combination of both. The description herein of any sequence of actions is not intended to imply that the specific order described for performing that sequence must be followed. All methods described herein may be performed in any suitable order unless otherwise indicated herein or otherwise clearly contradicted by context.

While one or more implementations have been described by way of example and in terms of the specific embodiments, it is to be understood that one or more implementations are not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A system for a computer game of chance, the system comprising:

one or more processors; and a non-transitory computer readable medium storing a plurality of instructions, which when executed, cause the one or more processors to:

display, via a user interface, at least a part of a field of play associated with a game of chance;

receive, via the user interface, a user selection of a region within the field of play;

evaluate a probability that an object will traverse the user-selected region during any of a plurality of random movements by the object from a beginning area to an ending area during a round of play;

display, via the user interface, at least one of the probability that the object will traverse the user-selected region during any of the plurality of random movements by the object from the beginning area to the ending area during the round of play, and a success value based on the probability, prior to displaying the object moving in the field of play during at least some of the plurality of random movements;

display, via the user interface, the object moving in the field of play during at least some of the plurality of random movements;

determine whether the object traversed the user-selected region during any of the plurality of random movements during the round of play; and credit the success value, based on the probability, to a player of the game of chance in response to a determination that the object traversed the user-selected region during any of the plurality of random movements during the round of play.

2. The system of claim 1, wherein the selection of the region comprises a selection of at least one of a geographical location of the region, a geographical dimension of the region, and the probability.

3. The system of claim 1, wherein the plurality of instructions, when executed, will further cause the one or more processors to receive, via the user interface, a selection of a wager value, wherein the success value is based on the wager value.

4. The system of claim 1, wherein receiving the user selection of the region comprises receiving a user selection of another region within the field of play, evaluating the probability that the object will traverse the user-selected region comprises evaluating the probability that the object will traverse at least one of the user-selected region and at the user-selected other region during any of the plurality of random movements by the object from the beginning area to the ending area during the round of play, determining whether the object traversed the user-selected region comprises determining whether the object traversed at least one of the user-selected region and the user-selected other region during any of the plurality of random movements, and the determination that the object traversed the user-selected region comprises a determination that the object traversed at least one of the user-selected region and the user-selected other region during any of the plurality of random movements.

5. The system of claim 1, wherein the plurality of instructions, when executed, will further cause the one or more processors to:

evaluate an intermediate probability that the object will traverse the user-selected region during any of a plurality of intermediate random movements from a current location of the object to the ending area during the round of play, each of the plurality of intermediate random movements comprising at least one of a vertical direction movement and a horizontal direction movement;

output, via the user interface, an intermediate success value, based on the intermediate probability and a wager value, as an intermediate game option;

determine whether the intermediate game option is selected; and credit the intermediate success value to the player of the game of chance in response to a determination that the intermediate game option is selected.

6. The system of claim 1, wherein the determination that the object traversed the user-selected region during any of the plurality of random movements during the round of play comprises a determination that another object traversed another user-selected region during any of a plurality of random movements by the other object during another round of play.

7. The system of claim 1, wherein the plurality of instructions, when executed, will further cause the one or more processors to debit, by a wager value, the player of the game of chance in response to a determination that the object did not traverse the user-selected region during any of the plurality of random movements.

8. A computer-implemented method for a computer game of chance, the method comprising:

displaying, via a user interface, at least a part of a field of play associated with a game of chance;

receiving, via the user interface, a user selection of a region within the field of play;

evaluating a probability that an object will traverse the user-selected region during any of a plurality of random movements by the object from a beginning area to an ending area during a round of play;

displaying, via the user interface, at least one of the probability that the object will traverse the user-selected region during any of the plurality of random movements by the object from the beginning area to the ending area during the round of play, and a success value based on the probability, prior to displaying the object moving in the field of play during at least some of the plurality of random movements;

displaying, via the user interface, the object moving in the field of play during at least some of the plurality of random movements;

determining whether the object traversed the user-selected region during any of the plurality of random movements during the round of play; and crediting the success value, based on the probability, to a player of the game of chance in response to a determination that the object traversed the user-selected region during any of the plurality of random movements during the round of play.

9. The computer-implemented method of claim 8, wherein the selection of the region comprises a selection of at least one of a geographical location of the region, a geographical dimension of the region, and the probability.

10. The computer-implemented method of claim 8, wherein the method further comprises receiving, via the user interface, a selection of a wager value, wherein the success value is based on the wager value.

11. The computer-implemented method of claim 8, wherein receiving the user selection of the region comprises receiving a user selection of another region within the field of play, evaluating the probability that the object will traverse the user-selected region comprises evaluating the probability that the object will traverse at least one of the user-selected region and at the user-selected other region during any of the plurality of random movements by the object from the beginning area to the ending area during the round of play, determining whether the object traversed the user-selected region comprises determining whether the object traversed at least one of the user-selected region and the user-selected other region during any of the plurality of random movements, and the determination that the object traversed the user-selected region comprises a determination that the object traversed at least one of the user-selected region and the user-selected other region during any of the plurality of random movements.

12. The computer-implemented method of claim 8, wherein the method further comprises:

evaluating an intermediate probability that the object will traverse the user-selected region during any of a plurality of intermediate random movements from a current location of the object to the ending area during the round of play, each of the plurality of intermediate random movements comprising at least one of a vertical direction movement and a horizontal direction movement;

outputting, via the user interface, an intermediate success value, based on the intermediate probability and a wager value, as an intermediate game option;

determining whether the intermediate game option is selected; and crediting the intermediate success value to the player of the game of chance in response to a determination that the intermediate game option is selected.

13. The computer-implemented method of claim 8, wherein the determination that the object traversed the user-selected region during any of the plurality of random movements during the game of chance comprises a determination that another object traversed another user-selected region during any of a plurality of random movements by the other object during another round of play.

14. The computer-implemented method of claim 8, wherein the method further comprises debiting, by a wager value, the player of the game of chance in response to a determination that the object did not traverse the user-selected region during any of the plurality of random movements.

15. A computer program product, comprising a non-transitory computer-readable medium having a computer-readable program code embodied therein to be executed by one or more processors, the program code including instructions to:

display, via a user interface, at least a part of a field of play associated with a game of chance;

receive, via the user interface, a user selection of a region within the field of play;

evaluate a probability that an object will traverse the user-selected region during any of a plurality of random movements by the object from a beginning area to an ending area during a round of play;

display, via the user interface, at least one of the probability that the object will traverse the user-selected region during any of the plurality of random movements by the object from the beginning area to the ending area during the round of play, and a success value based on the probability, prior to displaying the object moving in the field of play during at least some of the plurality of random movements;

display, via the user interface, the object moving in the field of play during at least some of the plurality of random movements;

determine whether the object traversed the user-selected region during any of the plurality of random movements during the round of play; and credit the success value, based on the probability, to a player of the game of chance in response to a determination that the object traversed the user-selected region during any of the plurality of random movements during the round of play.

16. The computer program product of claim 15, wherein the selection of the region comprises a selection of at least one of a geographical location of the region, a geographical dimension of the region, and the probability.

17. The computer program product of claim 15, wherein the program code includes further instructions to receive, via the user interface, a selection of a wager value, wherein the success value is based on the wager value.

18. The computer program product of claim 15, wherein receiving the user selection of the region comprises receiving a user selection of another region within the field of play, evaluating the probability that the object will traverse the user-selected region comprises evaluating the probability that the object will traverse at least one of the user-selected region and at the user-selected other region during any of the plurality of random movements by the object from the beginning area to the ending area during the round of play, determining whether the object traversed the user-selected region comprises determining whether the object traversed at least one of the user-selected region and the user-selected other region during any of the plurality of random movements, and the determination that the object traversed the user-selected region comprises a determination that the object traversed at least one of the user-selected region and the user-selected other region during any of the plurality of random movements.

19. The computer program product of claim 15, wherein the program code includes further instructions to:

evaluate an intermediate probability that the object will traverse the user-selected region during any of a plurality of intermediate random movements from a current location of the object to the ending area during the round of play, each of the plurality of intermediate random movements comprising at least one of a vertical direction movement and a horizontal direction movement;

output, via the user interface, an intermediate success value, based on the intermediate probability and a wager value, as an intermediate game option;

determine whether the intermediate game option is selected;

credit the intermediate success value to the player of the game of chance in response to a determination that the intermediate game option is selected.

20. The computer program product of claim 15, wherein the determination that the object traversed the user-selected region during any of the plurality of random movements during the round of play comprises a determination that another object traversed another user-selected region during any of a plurality of random movements by the other object during another round of play.

* * * * *